US010655423B2

(12) United States Patent
Stein et al.

(10) Patent No.: US 10,655,423 B2
(45) Date of Patent: May 19, 2020

(54) METHOD TO DELAY SWELLING OF A PACKER BY INCORPORATING DISSOLVABLE METAL SHROUD

(71) Applicant: Halliburton Energy Services, Inc., Houston, TX (US)

(72) Inventors: Taylor Justin Stein, Katy, TX (US); Darrell Adkins, Dallas, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/069,849

(22) PCT Filed: Mar. 1, 2016

(86) PCT No.: PCT/US2016/020250
§ 371 (c)(1),
(2) Date: Jul. 12, 2018

(87) PCT Pub. No.: WO2017/151118
PCT Pub. Date: Sep. 8, 2017

(65) Prior Publication Data

US 2019/0048680 A1 Feb. 14, 2019

(51) Int. Cl.
*E21B 33/12* (2006.01)
*E21B 43/16* (2006.01)

(52) U.S. Cl.
CPC ..... *E21B 33/12* (2013.01); *E21B 33/1208* (2013.01); *E21B 43/16* (2013.01)

(58) Field of Classification Search
CPC ..... E21B 33/12; E21B 33/1208; E21B 43/16
See application file for complete search history.

(56) References Cited

U.S. PATENT DOCUMENTS 1,975,390 A * 10/1934 Davic ..... E21B 33/12 166/181
3,960,211 A * 6/1976 Hutchison ..... E21B 33/127 166/187

(Continued)

FOREIGN PATENT DOCUMENTS

GB 2396635 A 6/2004
GB 2411918 A 9/2005

(Continued)

OTHER PUBLICATIONS

Korean Intellectual Property Office, PCT/US2016/020250, International Search Report and Written Opinion, dated Nov. 30, 2016, 16 pages, Korea.

(Continued)

*Primary Examiner* — Matthew R Buck
*Assistant Examiner* — Aaron L Lembo

(57) ABSTRACT

Swellable packer assemblies, and associated systems and methods are described for operation in connection with a subterranean wellbore. The swellable packer assemblies may include a shroud for maintaining a sealing element in a fully inactivated configuration until the packer assemblies reach a predetermined location in the wellbore. The shroud may be formed of a dissolvable metal material such that fluids in the wellbore may remove the shroud, and thereafter the sealing element may be rapidly expanded by exposure to fluids in the wellbore or by exposure to a trigger fluid pumped from the a surface location. The expanded sealing element may establish a seal with an outer tubular structure to isolate adjacent portions of the wellbore.

16 Claims, 5 Drawing Sheets

(56) References Cited

U.S. PATENT DOCUMENTS

| | | | | |
|---|---|---|---|---|
| 5,195,583 | A * | 3/1993 | Toon | E21B 33/1243 166/179 |
| 5,291,947 | A | 3/1994 | Stracke | |
| 7,387,158 | B2 * | 6/2008 | Murray | E21B 33/1208 166/179 |
| 7,624,793 | B2 * | 12/2009 | Freyer | E21B 33/1208 166/191 |
| 7,841,409 | B2 * | 11/2010 | Gano | E21B 33/1208 166/236 |
| 8,555,959 | B2 * | 10/2013 | Clemens | E21B 23/01 166/134 |
| 9,051,812 | B2 * | 6/2015 | Clemens | E21B 23/01 |
| 9,279,303 | B2 * | 3/2016 | Hales | E21B 33/1208 |
| 9,464,500 | B2 * | 10/2016 | Allison | E21B 33/1208 |
| 9,677,370 | B2 * | 6/2017 | Richards | E21B 33/134 |
| 2004/0055760 | A1 | 3/2004 | Nguyen | |
| 2006/0272806 | A1 | 12/2006 | Wilkie et al. | |
| 2008/0277109 | A1 | 11/2008 | Vaidya | |
| 2010/0025035 | A1 | 2/2010 | Korte et al. | |
| 2010/0139929 | A1 | 6/2010 | Rytlewski et al. | |
| 2010/0139930 | A1 * | 6/2010 | Patel | E21B 33/1277 166/387 |
| 2013/0153219 | A1 * | 6/2013 | Abrahamsen | E21B 33/1208 166/285 |
| 2014/0102726 | A1 | 4/2014 | Gamstedt et al. | |
| 2014/0102728 | A1 | 4/2014 | Gamstedt et al. | |
| 2015/0275617 | A1 | 10/2015 | Lou et al. | |

FOREIGN PATENT DOCUMENTS

| | | | |
|---|---|---|---|
| WO | WO-2008008687 | A1 | 1/2008 |
| WO | WO-2012121907 | A2 | 9/2012 |
| WO | WO-2014042657 | A1 | 3/2014 |
| WO | WO-2016024974 | A1 | 2/2016 |

OTHER PUBLICATIONS

European Patent Office, European Search Report, Supplementary Partial European Search Report, dated Sep. 5, 2019, 15 pages, Europe.

Examination Report issued for Singapore Patent Application No. 11201806163X, dated Dec. 5, 2019, 15 pages.

* cited by examiner

METHOD TO DELAY SWELLING OF A PACKER BY INCORPORATING DISSOLVABLE METAL SHROUD

CROSS-REFERENCE TO RELATED APPLICATIONS

This application is a U.S. national stage patent application of International Patent Application No. PCT/US2016/020250, filed on Mar. 1, 2016, the benefit of which is claimed and the disclosure of which is incorporated herein by reference in its entirety.

BACKGROUND

1. Field of the Invention

The present disclosure relates generally to downhole tools and operations related to oil and gas exploration, drilling and production. More particularly, embodiments of the disclosure relate to a swellable packer construction including a dissolvable metal shroud that operates to delay a swelling process for a sealing element disposed within the shroud.

2. Background

In operations related to exploration, drilling and production of hydrocarbons from subterranean geologic formations, packers or similar isolation tools are used to provide a fluid seal between tubular components in a wellbore. For example, a packer may be provided around an outer cylindrical surface of a tubing string, e.g., a completion string, which may be run into an outer tubular structure such as a casing string or an uncased portion of a wellbore. The packer may be radially expanded into contact with the inner surface of the outer tubular structure to create a seal in an annulus defined between the tubing string and the outer tubular structure. In some systems, mechanical or hydraulic systems may be employed to expand the packer. In other systems, the packer may be induced to expand by exposing swellable element in the packer to a predetermined trigger fluid in the wellbore.

Swellable packers may include an elastomeric element that is selected to expand in response to exposure to a particular trigger fluid. The trigger fluid may be a fluid present in the wellbore, e.g., a hydrocarbon based fluid, or a fluid pumped in to the wellbore from the surface. This type of passive actuation may make swellable packers attractive for use in some applications where space is too limited for mechanical or hydraulic systems, for example. Swellable packers may also offer reliability and robustness in long term sealing applications. In some instances, a swellable packer may begin to expand prior to reaching the intended location in the wellbore. For example, a swellable packer being run into a wellbore on a conveyance, e.g., tubing string, coiled tubing, a wireline or slickline, may reach the intended depth after a time period of about two days, and the swellable packer may be exposed to the trigger fluid throughout this time period. If there are unexpected delays in placing the packer, the swellable packer may make contact with an outer tubular structure at an unintended location. Continued swelling of the packer may cause the packer and/or the conveyance to become stuck in the wellbore.

BRIEF DESCRIPTION OF THE DRAWINGS

The disclosure is described in detail hereinafter on the basis of embodiments represented in the accompanying figures, in which.

DETAILED DESCRIPTION

Figure 1:
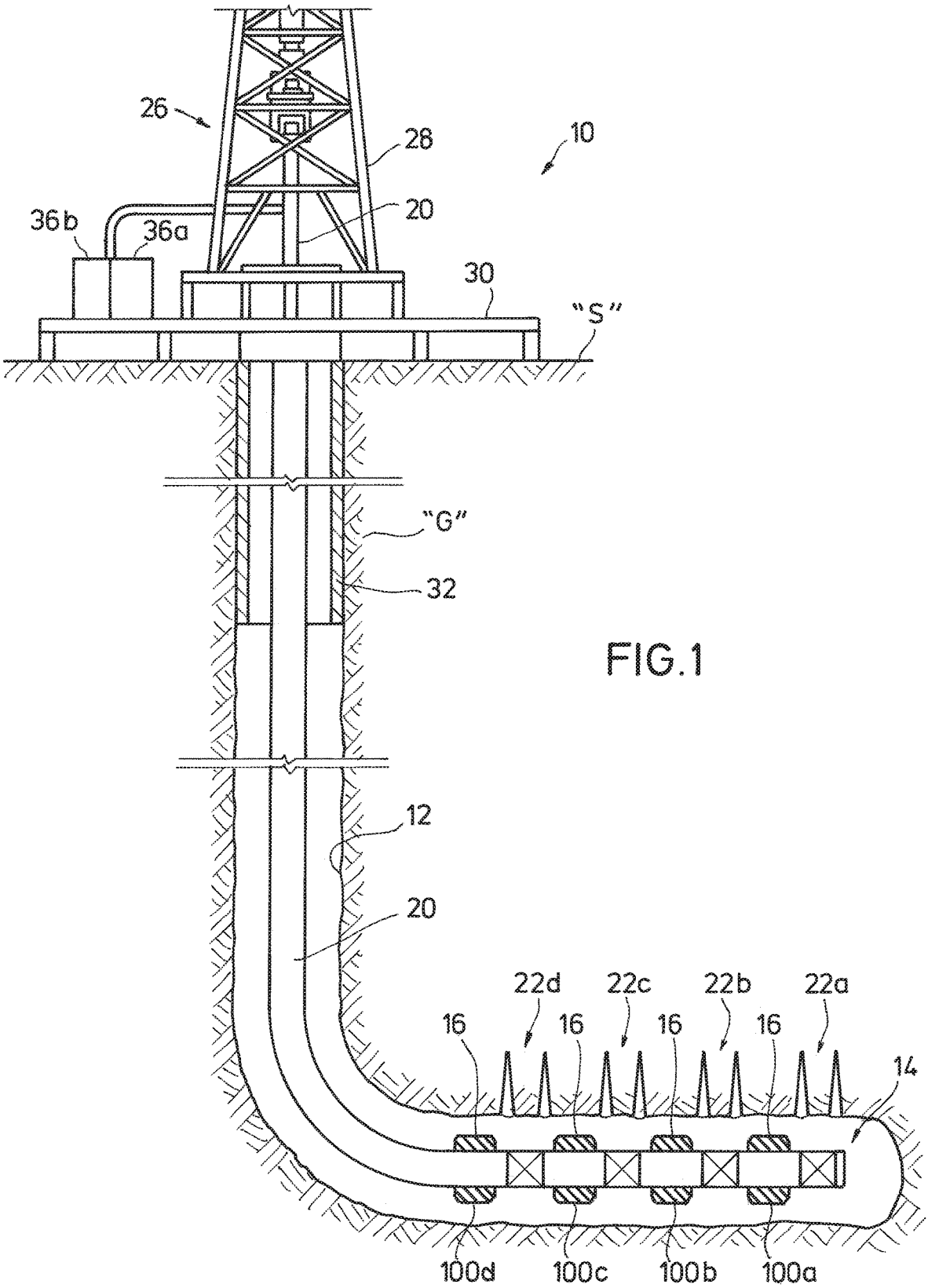
FIG. 1 is a partially cross-sectional side view of a downhole completion assembly including a plurality of swellable packer assemblies in operation in a production environment in accordance with exemplary embodiments of the disclosure.

The disclosure may repeat reference numerals and/or letters in the various examples or Figures. This repetition is for the purpose of simplicity and clarity and does not in itself dictate a relationship between the various embodiments and/or configurations discussed. Further, spatially relative terms, such as beneath, below, lower, above, upper, up-hole, downhole, upstream, downstream, and the like, may be used herein for ease of description to describe one element or feature's relationship to another element(s) or feature(s) as illustrated, the upward direction being toward the top of the corresponding figure and the downward direction being toward the bottom of the corresponding figure, the up-hole direction being toward the surface of the wellbore, the downhole direction being toward the toe of the wellbore. Unless otherwise stated, the spatially relative terms are intended to encompass different orientations of the apparatus in use or operation in addition to the orientation depicted in the Figures. For example, if an apparatus in the Figures is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Moreover even though a Figure may depict an apparatus in a portion of a wellbore having a specific orientation, unless indicated otherwise, it should be understood by those skilled in the art that the apparatus according to the present disclosure may be equally well suited for use in wellbore portions having other orientations including vertical, slanted, horizontal, curved, etc. Likewise, unless otherwise noted, even though a Figure may depict a terrestrial operation, it should be understood by those skilled in the art that the apparatus according to the present disclosure is equally well suited for use in offshore or subsea operations. Further, unless otherwise noted, even though a Figure may depict a wellbore that is partially cased, it should be understood by those skilled in the art that the apparatus according to the present disclosure may be equally well suited for use in fully open-hole wellbores.

1. Description of Exemplary Embodiments

The present disclosure includes swellable packer assemblies including a shroud disposed around a sealing element for isolating the sealing element from fluid outside the shroud and thereby maintaining the sealing element in a fully inactivated configuration. The shroud may be constructed of a dissolvable material, e.g., a dissolvable metal and/or a dissolvable polymer, such that fluids in the wellbore may remove the shroud, and thereafter the sealing element may be rapidly expanded by exposure to fluids in the wellbore to establish a seal with an outer tubular structure.

Referring to FIG. 1, a plurality of swellable packer assemblies 100*a*, 100*b*, 100*c*, 100*d*, referred to generically and/or collectively as swellable packer assemblies 100, are illustrated in the exemplary operating environment of a production system 10. The production system 10 may be employed for recovering hydrocarbons from a geologic formation "G" through a wellbore 12. It is noted that swellable packer assemblies 100 may also have application in wellbore servicing systems, drilling systems, wellbore storage and injection operations and the like. Although the illustrated wellbore 12 extends from a terrestrial surface location "S" disposed over the geologic formation "G," objects of the disclosure may also be practiced in connection with subsea applications wherein the surface location is a seafloor.

The swellable packer assemblies 100 of the production system 10, are components of a downhole completion assembly 14 disposed in a generally horizontal portion of the wellbore 12. The completion assembly 14 also includes various downhole tools such as interval control valves (ICVs) 16 that may be selectively opened and closed to permit and restrict fluid communication between the wellbore 12 and an interior of a tubing string 20. Although the completion assembly 14 is described as including ICVs 16, one skilled in the art will recognize that other downhole tools may alternatively or additionally be provided for the performance of various wellbore servicing operations, such as, a stimulation operation, a perforating operation, a fracturing operation, an acidizing operation, or the like. Each of the ICVs 16 are generally disposed within a portion of the wellbore 12 extending through one of a plurality formation zones 22*a*, 22*b*, 22*c* and 22*d* (collectively or generically formation zones 22). The swellable packer assemblies 100 are provided in the tubing string 20 between the ICVs 16 and longitudinally spaced from a the ICVs 16 such that swellable packer assemblies 100 may be activated (as described below) to fluidly isolate each ICV 16 in a in individual portions of the wellbore 12 corresponding to one of the formation zones 22*a*, 22*b*, 22*c* and 22*d*. Each ICV 16 is operable to selectively permit fluid communication between the tubing string 20 and an individual portion of the wellbore.

In this example embodiment, a drilling or servicing rig 26 is disposed at the surface location "S" and comprises a derrick 28 with a rig floor 30 through which the tubing string 20 passes. The drilling or servicing rig 26 may be conventional and may comprise a motor driven winch and other associated equipment for raising and lowering the tubing string 20 within the wellbore 12. The swellable packer assemblies 100 and ICVs 16 and are coupled within the tubing string 20 such that the drilling or servicing rig 26 may operate to raise and or lower (or move axially) the swellable packer assemblies 100 and ICVs 16 to a predetermined downhole location in the wellbore 12. The swellable packer assemblies 100 may be run into the wellbore 12 in the substantially inactivated configuration, as illustrated, in which the swellable packer assemblies 100 do not engage an outer tubular structure, e.g., a wall of the wellbore 12 or a casing string 32 that may be cemented into a portion of the wellbore 12.

In some embodiments, the tubing string 20 may comprise two or more concentrically positioned strings of pipe or tubing (e.g., a first work string may be positioned within a second work string). Moreover, the tubing string may alternatively include coiled tubing, drill string, a tool string, a segmented tubing string, a jointed tubing string, or any other suitable conveyance, or combinations thereof, that may be manipulated with a mobile workover rig, a wellbore servicing unit or another suitable apparatus for lowering and/or lowering the tubing string 20 within the wellbore 20. Thus, it is contemplated that the tubing string 20 may be utilized in drilling, stimulating, completing, or otherwise servicing the wellbore, or combinations thereof.

The production system 10 may further include at least one source 36*a*, 36*b* of trigger fluid for activating the swellable packer assemblies 100. The trigger fluid may be stored at the surface location "S" and pumped into the wellbore 12 at an appropriate time for activating the swellable packer assemblies 100. In some embodiments, a first source 36*a* and second source 36*b* of trigger fluid are distinct; such the swellable packer assemblies may be individually activated. For example, as described in greater detail below, a trigger fluid from a first source 36*a* may be pumped into the wellbore 12 to activate a first swellable packer assembly 100*a*. The trigger fluid from the first source 36*a*, however, may not be an appropriate fluid for activating a second swellable packer assembly 100*b*. Thus, the second swellable packer assembly 100*b* may remain in an inactivated state until a distinct trigger fluid from the second source 36*b* of trigger fluid is pumped into wellbore 12. In other embodiments, one or more of the packer assemblies 100 may be activated by wellbore fluids, e.g., hydrocarbon-based fluids or drilling fluids, already present in the wellbore 12. In example embodiments, the trigger fluid may be a water-based fluid (e.g., aqueous solutions, water, etc.), an oil-based fluid (e.g., hydrocarbon fluid, oil fluid, oleaginous fluid, terpene fluid, diesel, gasoline, xylene, octane, hexane, etc.), or combinations thereof. A commercial non-limiting example of an oil-based fluid includes EDC 95-11 drilling fluid.

Figure 2A:
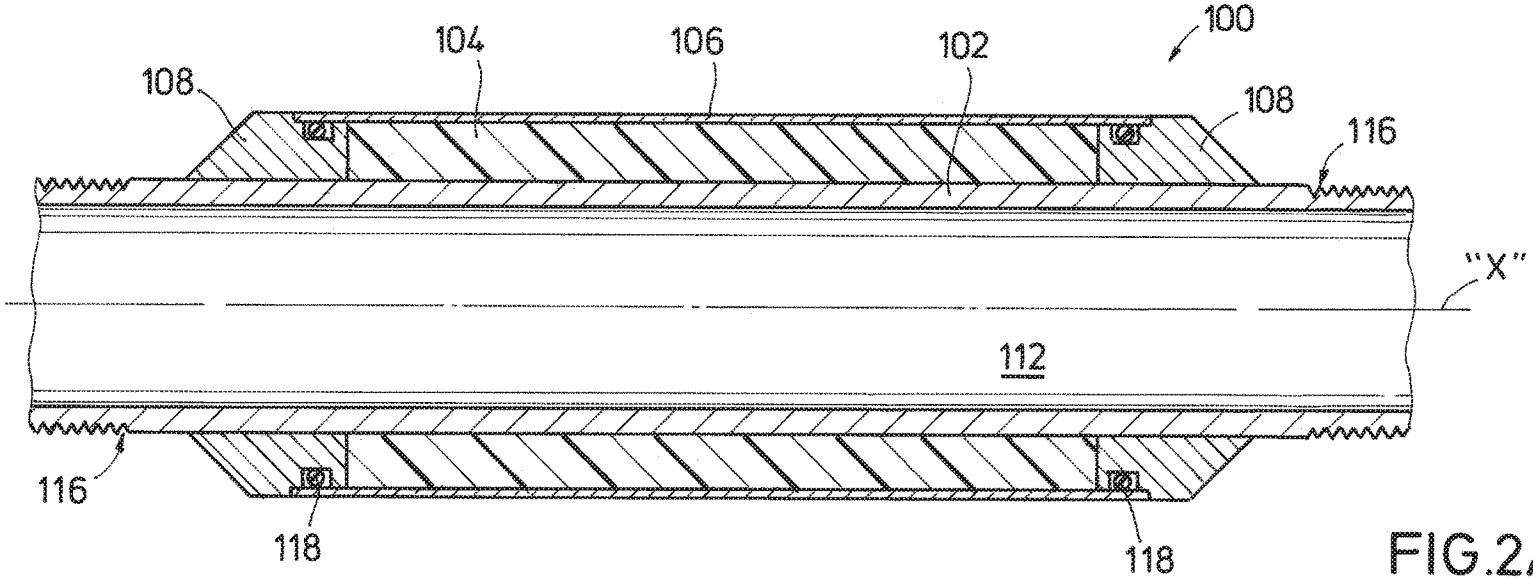
FIG. 2A is a cross-sectional side view of one of the swellable packer assemblies of FIG. 1 illustrating a shroud member for maintaining a sealing element of the packer in an inactivated configuration.

Referring now to FIG. 2A, an embodiment of a swellable packer assembly 100 is illustrated as extending along a longitudinal axis "X." In the embodiment illustrated in FIG. 2A, the swellable packer assembly 100 generally includes a mandrel 102, a sealing element 104 disposed circumferentially about at least a portion of the mandrel 102, a shroud member 106 disposed circumferentially about the sealing element 104, and a pair of retaining elements 108 upon which the shroud member 106 is supported on the mandrel 102.

In exemplary embodiments, the mandrel 102 may generally be constructed of a cylindrical or tubular body defining the longitudinal axis "X." The cylindrical or tubular body of the mandrel 102 may comprise a unitary structure, such as a continuous length of pipe or tubing, or alternatively, the mandrel 102 may be constructed of two or more operably connected components. In the illustrated embodiment, the mandrel 102 defines a continuous axial flowbore 112, which permits fluid communication through the mandrel 102. In other embodiments (not shown) the mandrel 102 may comprise a solid cylindrical member. In the illustrated embodiment, the mandrel 102 is configured for incorporation into the tubing string 20 (FIG. 1) buy a connectors 116 formed on axial ends of the mandrel. The connectors 116 may include a threaded portion of the mandrel 102 as illustrated, or alternatively, the connectors 116 may include any other suitable connections into a tubing string 20 as will be appreciated by those skilled in the art. In the illustrated embodiment, the connectors 116 permit the mandrel 102 to be incorporated within the tubing string 20 such that the axial flowbore 112 of the mandrel 102 is in fluid communication with the interior or the tubing string 20.

The retaining elements 108 are disposed circumferentially about the mandrel 102 on each longitudinal side of the sealing element 104. The retaining elements 108 may be fixedly secured to the mandrel 102 by welding, screws, pins or similar mechanisms such that the retaining elements 108 may prevent or limit the longitudinal movement (e.g., along the longitudinal axis "X") of the sealing element 104 along the mandrel 102. The retaining elements 108 permit radial expansion of the sealing element 104 while limiting longitudinal movement of the sealing element 104. The retaining elements 108 may include various elements, including but not limited to one or more spacer rings, one or more slips, one or more slip segments, one or more slip wedges, one or more extrusion limiters, and the like, or combinations thereof.

In the illustrated embodiment, the retaining elements 108 support the shroud member 106 on the mandrel 102 circumferentially about the sealing element 104. The shroud member 106 is supported on the mandrel 102 to fluidly isolate the sealing element 104 from an exterior of the shroud member 106. In some embodiments, a sealing member 118 such as an elastomeric o-ring may be provided between the shroud member 106 and retaining elements 108 to facilitate fluidly isolating the sealing element 104 between the mandrel and the shroud. 106. The shroud member 106 is selectively removable from the mandrel 102 downhole so as to expose the sealing element 104 to a trigger fluid. In some exemplary embodiments, mechanical or hydraulic mechanisms (not shown) may be employed to remove the shroud member 106. In the illustrated embodiments, the shroud member 106 may be constructed of a dissolvable material such the shroud member 106 may dissolve in response to exposure to wellbore fluids. In some example embodiments, the shroud member 106 is constructed of dissolvable metal material and/or a dissolvable polymer.

Generally, a "dissolvable" material, as used herein, refers to a material configured for passive degradation or dissolution upon exposure to downhole well conditions. For example, dissolvable materials may include any metal material that has an average dissolution rate in excess of 0.01 $mg/cm^2/hr$ at 200° F. in a 15% KCl solution. Dissolvable metal materials may also generally include metal materials that lose greater than 0.1% of their total mass per day at 200° F. in a 15% KCl solution. Dissolvable metal materials may readily combine with oxygen to form very stable oxides, and/or may interact with water and produce diatomic hydrogen, and/or may become easily embrittled by interstitial absorption of oxygen, hydrogen, nitrogen, or other non-metallic elements. Dissolvable metal materials may include calcium-magnesium (Ca—Mg) alloys, calcium-aluminum (Ca—Al) alloys, calcium-zinc (Ca—Zn) alloys, magnesium-lithium (Mg—Li) alloys, aluminum-gallium (Al—Ga) alloys, aluminum-indium (Al—In) alloys, and aluminum-gallium-indium (Al—Ga—In) alloys. Some dissolvable materials include aluminum with an alloying agent of one or more of gallium, indium, bismuth and tin in a minor proportion.

The shroud member 106 may degrade or dissolve when exposed to fluid at wellbore conditions. The fluid at wellbore conditions may be an aqueous fluid, a water-based fluid, organic fluid, and/or a hydrocarbon-based fluid. The shroud member 106 may be configured to degrade or dissolve at a predetermined rate such that the sealing element 104 remains fluidly isolated for a predetermined amount of time. A thickness of the shroud member 106 may be selected such that the shroud member 106 will not degrade until the swellable packer assembly 100 may be run downhole to reach a particular wellbore zone 22*a*, 22*b*, 22*c*, 22*d* (FIG. 1) or another predetermined location in the wellbore 12 (FIG. 1). In some exemplary embodiments, the thickness of the shroud may be at least about 0.0179 (at least about 18 mils or 0.45 mm) such that the shroud member 106 may be maintained for a period of about 2 days or more.

Once the shroud member 106 is dissolved, the sealing element 104 may be exposed to fluids in the wellbore 12 (FIG. 1), which, as described above, may include a trigger fluid pumped from the surface location "S" or already present in the wellbore 12. The sealing element 104 is constructed of a "swellable material" such that exposure to the trigger fluid the wellbore 12 may induce swelling of the sealing element 104 in a radial direction. For purposes of this disclosure, a "swellable material" may include any material (e.g., a polymer or an elastomer) that swells (e.g., exhibits an increase in mass and volume) upon contact or exposure with a selected fluid, i.e., a trigger fluid or swelling agent. Herein the disclosure may refer to a polymer and/or a polymeric material. It is to be understood that the terms polymer and/or polymeric material herein are used interchangeably and are meant to each refer to compositions comprising at least one polymerized monomer in the presence or absence of other additives traditionally included in such materials. Examples of polymeric materials suitable for use as part of the swellable material of sealing element 104 include, but are not limited to homopolymers, random, block, graft, star-branched and hyper-branched polyesters, copolymers thereof, derivatives thereof, or combinations thereof. The term "derivative" herein is defined to include any compound that is made from one or more of the swellable materials, for example, by replacing one atom in the swellable material with another atom or group of atoms, rearranging two or more atoms in the swellable material, ionizing one of the swellable materials, or creating a salt of one of the swellable materials. The term "copolymer" as used herein is not limited to the combination of two polymers, but includes any combination of any number of polymers, e.g., graft polymers, terpolymers, and the like.

For purposes of disclosure herein, the swellable material may be characterized as a resilient, volume changing material. In an embodiment, the swellable material of the sealing element 104 may swell by from about 105% to about 500%, alternatively from about 115% to about 400%, or alternatively from about 125% to about 200%, based on the original volume at the surface location "S" or downhole prior to dissolving the shroud member 106, i.e., the volume of the swellable material of the sealing element 104 prior to contacting the swellable material of the sealing element 104 with the trigger fluid. In an embodiment, a swell gap of the sealing element 104 may increase by from about 105% to about 250%, alternatively from about 110% to about 200%, or alternatively from about 110% to about 150%, based on the thickness of the sealing element 104 prior to contacting the swellable material of sealing element 104 with the trigger fluid. For purposes of the disclosure herein, the swell gap is defined by an increase in a radius of the sealing element 104 upon swelling divided by a thickness of the sealing element 104 prior to swelling. As will be appreciated by one of skill in the art, and with the help of this disclosure, the extent of swelling of a sealing element 104 may depend upon a variety of factors, including the downhole environmental conditions (e.g., temperature, pressure, composition of formation fluid in contact with the sealing element 104, specific gravity of the fluid, pH, salinity, etc.). For purposes of the disclosure herein, upon swelling to at least some extent (e.g., partial swelling, substantial swelling, full swelling), the swellable materials may be referred to as "swelled materials." In some embodiments, the sealing element 104 may be configured to exhibit a radial expansion (e.g., an increase in exterior diameter) upon being contacted with a particular trigger fluid.

In some embodiments, the sealing element 104 may generally comprise a hollow cylindrical structure having an interior bore (e.g., a tube-like and/or a ring-like structure). The sealing element 104 may comprise a suitable internal diameter, a suitable external diameter, and/or a suitable thickness, for example, as may be selected by one of skill in the art upon viewing this disclosure and in consideration of factors including, but not limited to, the size/diameter of the mandrel 102, the tubular structure 134 (FIG. 3A) against which the sealing element 104 is configured to engage, the force with which the sealing element 104 is intended or configured to engage the outer tubular structure 134, or other related factors. For example, the internal diameter of the sealing element 104 may be about the same as an external diameter of the mandrel 102. In an embodiment, the sealing element 104 may be in sealing contact (e.g., a fluid-tight seal) with the mandrel 102. While the embodiment of FIG. 2A illustrates a swellable packer assembly 100 comprising a single sealing element 104, one of skill in the art, upon viewing this disclosure, will appreciate that a similar swellable packer assembly may include two, three, four, five, or any other suitable number of sealing elements 104.

Figure 2B:
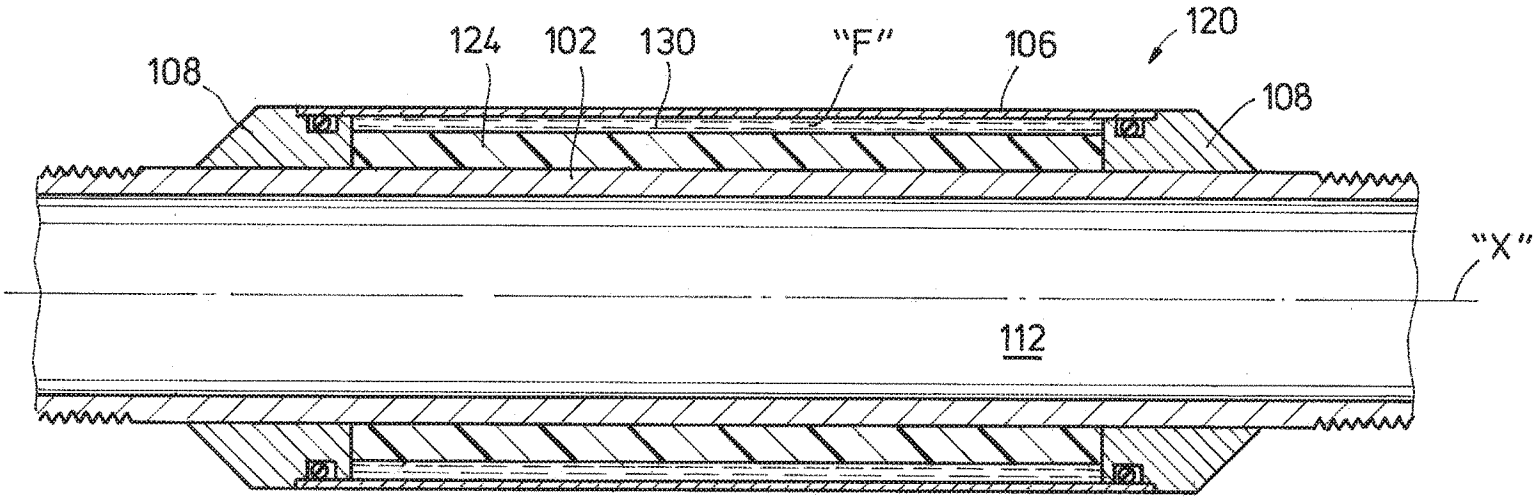
FIG. 2B is a cross sectional side view of a swellable packer assembly constructed in accordance with alternate embodiments of the disclosure illustrating an annular cavity defined between a shroud member and a sealing element.

Referring now to FIG. 2B, a swellable packer assembly 120 constructed in accordance with alternate embodiments of the disclosure include a sealing element 124 that is substantially spaced from the shroud member 106 to define an annular cavity 130 between the shroud member 106 and a sealing element 124. Upon dissolving through a portion of the shroud member 106, the annular cavity 130 permits a trigger fluid to substantially surround the sealing element 124, thereby facilitating rapid expansion of the sealing element 124. In some embodiments, the annular cavity 130 may be filled with a substantially non-compressible fluid "F," e.g., a liquid, prior to running the swellable packer assembly 120 into the wellbore 12 (FIG. 1). The non-compressible fluid "F" may support the shroud member 106, and may be selected such that the non-compressible fluid "F" does not activate the sealing element 124 alone. Once the shroud member 106 is at least partially dissolved, the non-compressible fluid "F" may be displaced by or mixed with or a trigger fluid to induce swelling of the sealing element 124.

3. Example Methods of Operation

Figure 3A:
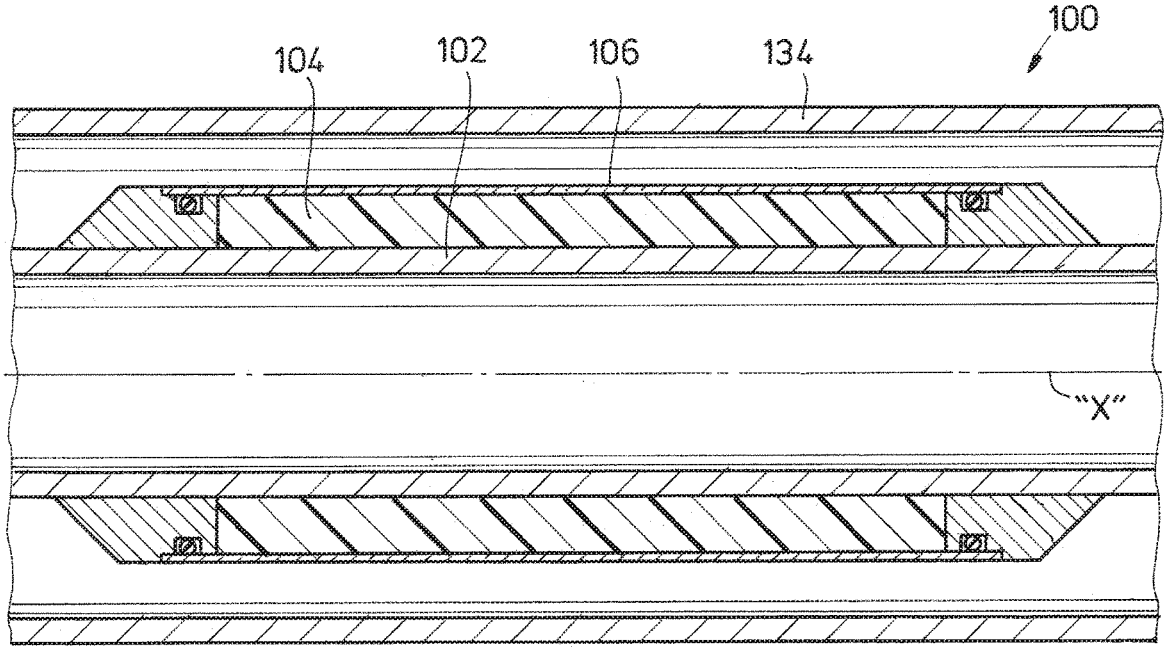
FIGS. 3A through 3B are a schematic views of an a swellable packer assembly of FIG. 1 in respective sequential phases of installation into an outer tubular structure.
Figure 3B:
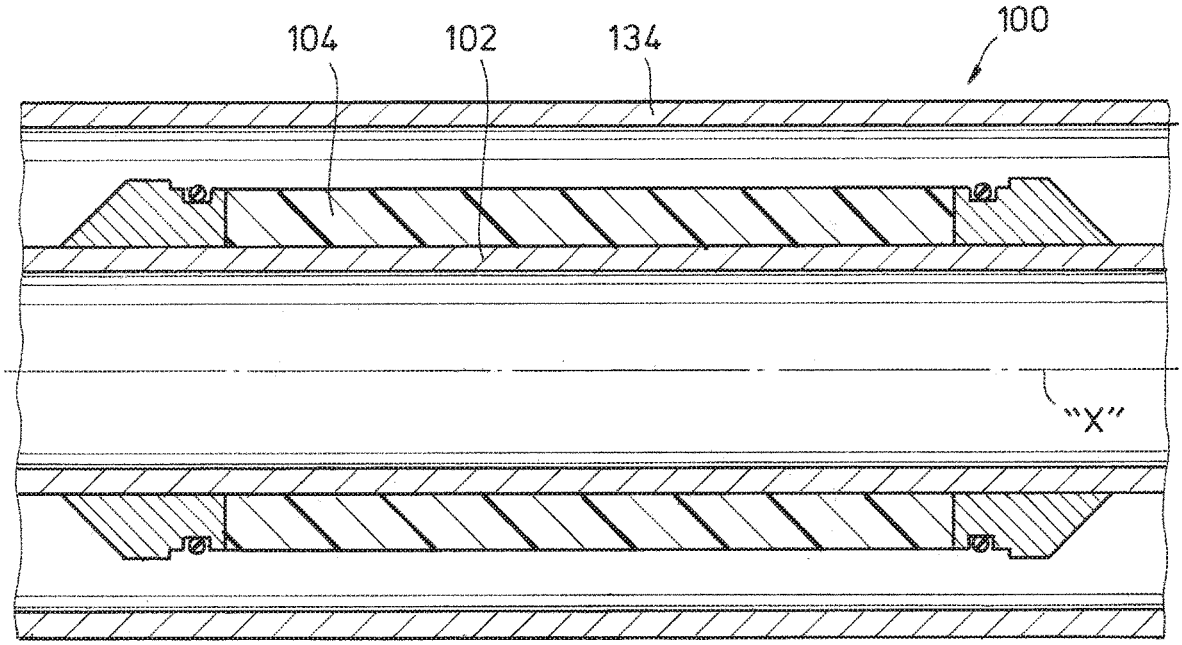
Figure 4:
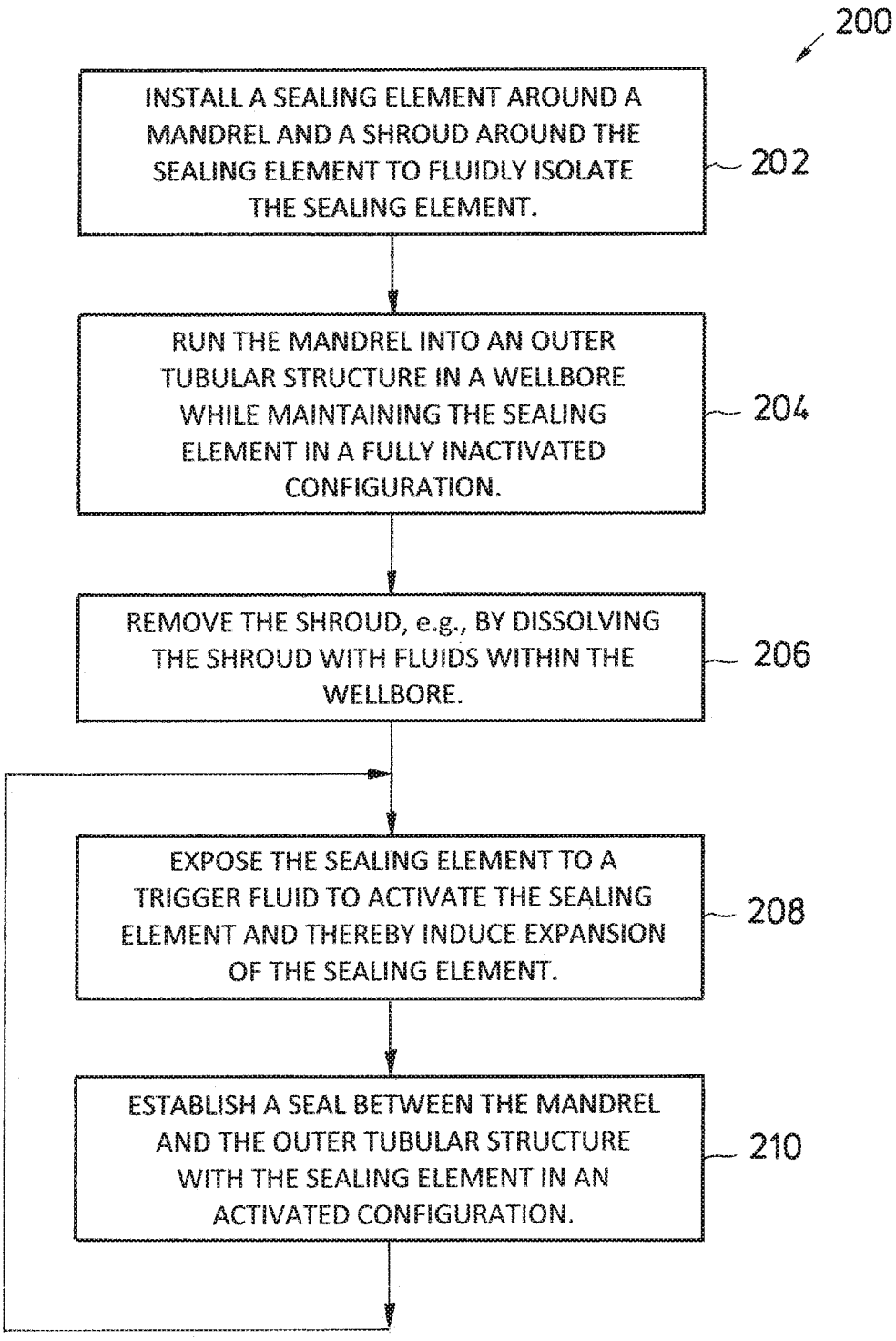
FIG. 4 is a flowchart illustrating an operational procedure for installing and operating a swellable packer assembly of FIG. 1 in a wellbore in accordance with one or more exemplary embodiments of the disclosure.

Referring to FIGS. 3A-3B and to FIG. 4, an operational procedure 200 is described for using the swellable packer assembly 100 in accordance with one or more exemplary embodiments of the disclosure. Initially at step 202, a sealing member 104 is installed around a mandrel 102, and a shroud member 106 is installed around the sealing member 104 to fluidly isolate the sealing member 104 from an exterior of the shroud 104. The shroud member 106 may be fastened to retaining elements 108 or directly to the mandrel 102 with fasteners, by welding, brazing or other suitable methods recognized in the art.

Next, at step 204, the swellable packer assembly 100 may be run into a tubular structure 134 (FIG. 3A) in a wellbore 12 (FIG. 1) with the sealing element 104 in an inactivated configuration. The tubular structure 134 may include any wellbore tubular such as a casing string 32 (FIG. 1) or a wellbore wall defined by a geologic formation "G." While the swellable packer assembly 100 is being run into the wellbore 12, the shroud member 106 may begin to dissolve. In some embodiments, running the swellable packer assembly into the wellbore may take about 2 days. Since the sealing member 104 is fluidly isolated within the shroud 106, the sealing element 104 may remain in a fully or substantially inactivated configuration until the swellable packer assembly 100 reaches its intended position in the wellbore 12. If there are unexpected delays in running the swellable packer assembly 100 into the wellbore 12, the shroud member 106 delays any swelling of the sealing element 104 and potentially allows for the swellable packer assembly 100 to be removed from the wellbore 12 prior to the sealing element 104 engaging the wellbore 12 in an unintended position, which could frustrate removal of the swellable packer assembly 100.

Once the swellable packer assembly 100 is properly positioned within the outer tubular member 134, the shroud member 106 may be removed at step 206 (FIG. 3B). In some embodiments, the shroud member 106 is removed by dissolving the shroud member with the fluids present in the wellbore. In other embodiments, the shroud may be removed by mechanical or hydraulic activation mechanism (not shown) as appreciated by those skilled in the art.

Next, at step 208, the sealing element 208 is exposed to a trigger fluid in the wellbore 12 (FIG. 1). The trigger fluid may be operable to induce swelling of all of the sealing elements 104 in a wellbore 12 simultaneously or a subset of the sealing elements 104 in the wellbore 12. The swelling of the sealing member 104 may induce a radial expansion of the sealing element 104, e.g., toward the outer tubular structure 134. The sealing element 208 may be exposed to trigger fluid by pumping the trigger fluid into the wellbore 12 from at least one of the sources 36*a*, 36*b* at the surface location "S" or removal of the shroud member may permit exposure of the sealing element 104 to a trigger fluid already present in the wellbore 12.

Figure 3C:
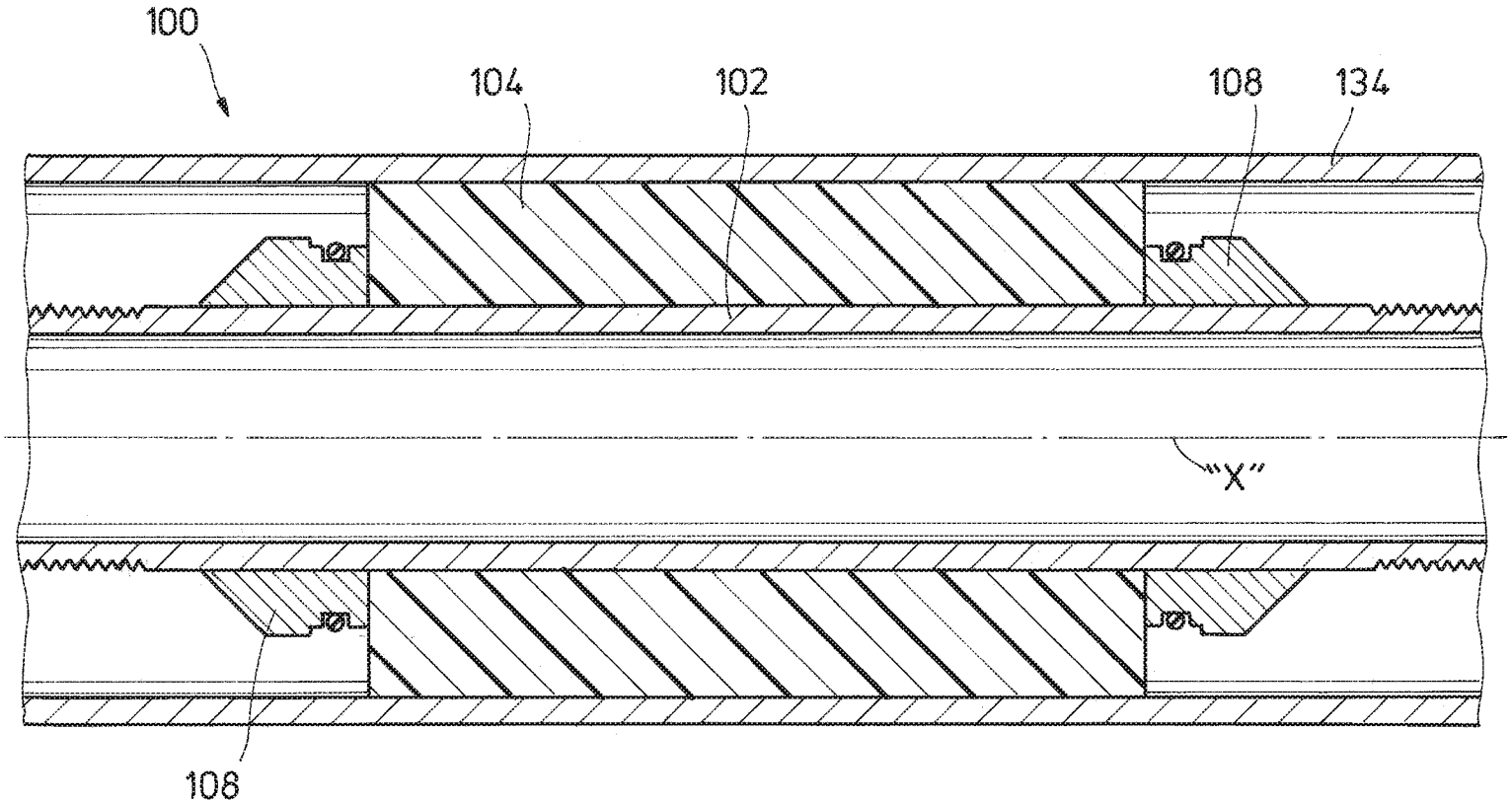

Continued swelling of the sealing element 104 may create a seal between the mandrel 102 and the outer tubular structure 134 at step 210 (FIG. 3C). In some embodiments, the swelling may cause an initial contact between the sealing element 104 and the outer tubular structure 134 in about 3 days, and may continue so swell to reach a maximum differential pressure rating in about an additional 5 days. The retaining elements 108 may limit the longitudinal movement of the sealing element 104 while it swells and radially expands. In some embodiments, the sealing element 104 may generally be configured to selectively seal and/or isolate two or more adjacent portions of an annular space surrounding the tubing string 20 (FIG. 1) or other conveyance (e.g., between the tubing string 20 and the tubular structure 134. For example, sealing element 104 may selectively provide a barrier extending circumferentially around at least a portion of an exterior of the mandrel 102.

In some embodiments, the procedure 200 may then return to step 208, where a second trigger fluid may be introduced to induce swelling of a sealing element 104 in an additional swellable packer assembly 100. For example, a first particular trigger fluid, e.g., from first source 36*a*, may induce swelling of the sealing element 104 of swellable packer assembly 100*a* (FIG. 1), but the sealing element 104 of a second swellable packer assembly 100*b* (FIG. 1) may not be triggered by the particular trigger fluid. A distinct second trigger fluid, e.g., from second source 36*b*, may be introduced to induce activation, e.g., swelling, of the sealing element 104 of the second swellable packer assembly 100*b*. In this manner, the swellable packer assemblies 100*a*, 100*b*, 100*c*, and 100*d* may be sequentially activated to fluidly isolate adjacent portions of the wellbore. In some embodiments, once the sealing elements are activated, a wellbore fluid from the wellbore may be produced from the wellbore (e.g., through ICV 16 (FIG. 1)), or an injection fluid may be injected into an individual one of the adjacent portions of the wellbore 12.

4. Aspects of the Disclosure

The aspects of the disclosure described in this section are provided to describe a selection of concepts in a simplified form that are described in greater detail above. This section is not intended to identify key features or essential features of the claimed subject matter, nor is it intended to be used as an aid in determining the scope of the claimed subject matter.

In one aspect, the disclosure is directed to a swellable packer assembly for positioning in a wellbore. The swellable packer assembly includes a mandrel, a sealing element disposed about the mandrel, and a shroud coupled to the mandrel to fluidly isolate the sealing element from an exterior of the shroud. The sealing element is formed of a material responsive to exposure to a trigger fluid to radially expand from the mandrel, and the shroud is selectively removable from the mandrel downhole so as to expose the sealing element to the trigger fluid in the wellbore.

In one or more embodiments, shroud is constructed of a dissolvable metal material, and the dissolvable metal material may include at least one of a magnesium alloy, an aluminum alloy, nickel, copper, and tin. In some embodiments, the dissolvable metal material exhibits a thickness of at least about 0.0179 inches or at least about 18 mils. In some embodiments the mandrel defines a longitudinal passageway therethrough. In some embodiments, the shroud is constructed of a dissolvable polymer.

In some embodiments, the swellable packer assembly further includes at least one retaining element fixedly coupled to the mandrel adjacent the sealing element such that the at least one retaining element limits longitudinal movement of the sealing element along the mandrel. The shroud may be supported on the mandrel by the at least one retaining element, and the at least one retaining element may support the shroud such that an annular cavity is defined between the sealing element and the shroud. The annular cavity may be filled with a substantially non-compressible fluid.

In another aspect, the disclosure is directed to a method of using a swellable packer assembly. The method includes (a) running the swellable packer assembly into a wellbore on a conveyance to position the swellable packer assembly at a predetermined downhole location with a sealing element of the swellable packer assembly in an inactivated configuration, (b) removing a shroud from the swellable packer assembly, subsequent to running the swellable packer assembly into the wellbore, and (c) exposing the sealing element to a trigger fluid at the predetermined location to thereby activate to sealing element to induce swelling of the sealing element.

In some embodiments, removing the shroud further includes dissolving a dissolvable material of the shroud with wellbore fluid disposed at the predetermined downhole location. In one or more exemplary embodiments, exposing the sealing element to the trigger fluid further comprises pumping the trigger fluid into the wellbore from a surface location subsequent to running the swellable packer assembly into the wellbore. In some embodiments, exposing the sealing element to the trigger fluid further includes comprises flooding an annular cavity surrounding the sealing element with the wellbore fluid disposed at the predetermined downhole location.

In one or more exemplary embodiments, the method further includes fluidly isolating at least two adjacent portions of the wellbore with the sealing element subsequent to exposing the sealing element to the trigger fluid. In some embodiments, the method may further include producing a wellbore fluid from or injecting an injection fluid into an individual one of the adjacent portions of the wellbore.

In another aspect the disclosure is directed to a downhole swellable packer system including a conveyance, at least one mandrel coupled within the conveyance, at least one sealing element disposed about the mandrel, the at least one sealing element formed of a material responsive to exposure to a trigger fluid to radially expand from the at least one mandrel, and at least one shroud coupled to the at least one mandrel to fluidly isolate the at least one sealing element from an exterior of the shroud. The at least one shroud is constructed of a dissolvable material and is substantially spaced in a radial direction from an outer surface of the at least one sealing element.

In some exemplary embodiments, the downhole swellable packer system further includes a downhole tool coupled within the conveyance, wherein the downhole tool is longitudinally spaced from the sealing element such that the sealing element may fluidly isolate the downhole tool in an individual portion of the wellbore. In some embodiments, the conveyance is a tubing string and the downhole tool is an inflow control valve operable to selectively permit fluid communication between the wellbore and the tubing string.

In some exemplary embodiments, the downhole swellable packer system further includes a first source of trigger fluid selectively deliverable to the sealing element. In some embodiments, the downhole swellable packer system further includes a second sealing element and a source of a second distinct trigger fluid, wherein the second sealing element is formed of a material responsive to exposure to the second distinct trigger fluid to radially expand.

The Abstract of the disclosure is solely for providing the United States Patent and Trademark Office and the public at large with a way by which to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed is:

1. A swellable packer assembly for positioning in a wellbore, the swellable packer assembly comprising:

a mandrel;

a swellable sealing element disposed radially about the mandrel, the sealing element formed of a material responsive to exposure to a trigger fluid to radially expand from the mandrel;

at least one retaining element fixedly coupled to the mandrel adjacent the sealing element such that the at least one retaining element limits longitudinal movement of the sealing element along the mandrel; and a shroud sealingly coupled to the at least one retaining element to fluidly isolate the sealing element from an exterior of the shroud and to define an annular cavity disposed radially between the sealing element and the shroud, the shroud selectively removable from the mandrel downhole so as to expose the sealing element to the trigger fluid in the wellbore.

2. The swellable packer assembly of claim 1, wherein the shroud is constructed of a dissolvable metal material.

3. The swellable packer assembly of claim 2, wherein the dissolvable metal material comprises at least one of a magnesium alloy, an aluminum alloy, nickel, copper, and tin.

4. The swellable packer assembly of claim 2, wherein the dissolvable metal material exhibits a thickness of at least about 0.0179 inches or at least about 18 mils.

5. The swellable packer assembly of claim 1, wherein the annular cavity is filled with a substantially non-compressible fluid.

6. The swellable packer assembly of claim 1, wherein the mandrel defines a longitudinal passageway therethrough.

7. A method of using a swellable packer assembly comprising:

running the swellable packer assembly into a wellbore on a conveyance to position the swellable packer assembly at a predetermined downhole location with a swellable sealing element of the swellable packer assembly in an inactivated configuration wherein a shroud is sealingly coupled to retaining elements disposed on each longitudinal side of the sealing element to define an annular cavity radially between the sealing element and the shroud;

removing the shroud from the retaining elements, subsequent to running the swellable packer assembly into the wellbore;

flooding the annular cavity with a wellbore fluid disposed at the predetermined downhole location in response to removing the shroud; and exposing the sealing element to a trigger fluid in the wellbore at the predetermined location to thereby activate to sealing element to induce swelling of the sealing element.

8. The method of claim 7, wherein removing the shroud further comprises dissolving a dissolvable material of the shroud with wellbore fluid disposed at the predetermined downhole location.

9. The method of claim 8, wherein exposing the sealing element to the trigger fluid further comprises pumping the trigger fluid into the wellbore from a surface location subsequent to running the swellable packer assembly into the wellbore.

10. The method of claim 7, further comprising fluidly isolating at least two adjacent portions of the wellbore with the sealing element subsequent to exposing the sealing element to the trigger fluid.

11. The method of claim 10, further comprising producing a wellbore fluid from or injecting an injection fluid into an individual one of the adjacent portions of the wellbore.

12. A downhole swellable packer system comprising:

a conveyance;

a mandrel coupled within the conveyance;

a swellable sealing element disposed about the one mandrel, the sealing element formed of a material responsive to exposure to a trigger fluid to radially expand from the mandrel;

at least one retaining element coupled to the mandrel adjacent the sealing element such that the at least one retaining element limits longitudinal movement of the sealing element along the mandrel; and a shroud coupled to the at least one retaining element to fluidly isolate the sealing element from an exterior of the shroud and to define an annular cavity disposed radially between the sealing element and the shroud, the shroud constructed of a dissolvable material and substantially spaced in a radial direction from an outer surface of the sealing element.

13. The downhole swellable packer system of claim 12, further comprising a downhole tool coupled within the conveyance, wherein the downhole tool is longitudinally spaced from the sealing element such that the sealing element may fluidly isolate the downhole tool in an individual portion of the wellbore.

14. The downhole swellable packer system of claim 13, wherein the conveyance is a tubing string and the downhole tool is an inflow control valve operable to selectively permit fluid communication between the wellbore and the tubing string.

15. The downhole swellable packer system of claim 12, further comprising a first source of trigger fluid selectively deliverable to the sealing element.

16. The downhole swellable packer system of claim 15, further comprising a second sealing element and a source of a second distinct trigger fluid, wherein the second sealing element is formed of a material responsive to exposure to the second distinct trigger fluid to radially expand.

* * * * *